US006260402B1

(12) United States Patent
Leek

(10) Patent No.: US 6,260,402 B1
(45) Date of Patent: Jul. 17, 2001

(54) METHOD FOR FORMING A SHORT-RADIUS BEND IN FLANGED SHEET METAL MEMBER

(75) Inventor: William F. Leek, Carmel, CA (US)

(73) Assignee: Simpson Strong-Tie Company, Inc., Dublin, CA (US)

( * ) Notice: Subject to any disclaimer, the term of this patent is extended or adjusted under 35 U.S.C. 154(b) by 0 days.

(21) Appl. No.: 09/266,416

(22) Filed: Mar. 10, 1999

(51) Int. Cl.[7] ..... B21D 47/00

(52) U.S. Cl. ..... 72/379.2; 72/335; 72/411

(58) Field of Search ..... 72/377, 335, 339, 72/379.2, 411, 701, 333, 324, 356; 29/897.3, 897.35

(56) References Cited

U.S. PATENT DOCUMENTS

| | | | |
|---|---|---|---|
| 625,427 | | 5/1899 | Stewart . |
| 1,343,647 | | 6/1920 | Smith . |
| 1,925,804 | | 9/1933 | Hiering . |
| 1,958,467 | | 5/1934 | Buckle . |
| 2,006,925 | | 7/1935 | Klemp . |
| 2,055,185 | * | 9/1936 | Templeton ..... 72/404 |
| 2,086,225 | | 7/1937 | Hiering . |
| 3,055,103 | | 9/1962 | Fernberg . |
| 3,338,084 | | 8/1967 | Stegman . |
| 3,633,950 | | 1/1972 | Gilb . |
| 3,857,270 | | 12/1974 | Iten . |
| 3,879,144 | | 4/1975 | Eckerbrecht . |
| 4,291,996 | | 9/1981 | Gilb . |
| 4,414,785 | | 11/1983 | Howell . |
| 4,480,941 | | 11/1984 | Gilb . |
| 4,525,972 | | 7/1985 | Palacio et al. . |
| 4,598,521 | | 7/1986 | Slapsys et al. . |
| 4,802,786 | | 2/1989 | Yauger . |
| 4,817,359 | | 4/1989 | Colonias . |
| 4,920,725 | | 5/1990 | Gore . |
| 5,022,209 | | 6/1991 | Kimura . |
| 5,104,252 | | 4/1992 | Colonias et al. . |
| 5,203,069 | | 4/1993 | Hennig . |
| 5,263,296 | | 11/1993 | Spera . |
| 5,806,265 | | 9/1998 | Sluiter . |

FOREIGN PATENT DOCUMENTS

| | | | |
|---|---|---|---|
| 2228955 | | 9/1990 | (GB) . |
| 6-262267 | * | 9/1994 | (JP) ..... 72/379.2 |

OTHER PUBLICATIONS

Simpson Strong–Tie Co., Inc. catalog No. 79H–1 Copyright 1978, Cover Page and p. 16.
Simpson Strong–Tie Co., Inc. catalog No. 66H1 Copyright 1965, Cover Page and p. 3.
Bulldog–Simpson GMBH catalog, Copyright 1999, Cover Page and p. 3.

* cited by examiner

*Primary Examiner*—Lowell A. Larson
(74) *Attorney, Agent, or Firm*—James R. Cypher; Charles R. Cypher

(57) ABSTRACT

One or more closed perimeter openings are formed in the compression area of a flange of a member that is to be bent transversely to the flange. The member is bent along a transverse bend line, and the flanges are bent inwardly on themselves. The bending of the member along the transverse bend line is done with a great force, and because portions of the side flanges are supported on their distal and proximal side, the material of the side flanges in the compression area plasticizes and flows into the closed perimeter opening, causing them to deform. Because the closed perimeter opening or openings are present, the side flanges are compressed in a more controlled manner, reducing cracking, wrinkling and thinning during the bending of the member along the transverse bend line.

10 Claims, 13 Drawing Sheets

METHOD FOR FORMING A SHORT-RADIUS BEND IN FLANGED SHEET METAL MEMBER

BACKGROUND

The present invention relates to a process of manufacture and the product made therefrom. It relates to shaping sheet metal blanks, particularly to operations in which a sheet metal member having a continuous flange is folded along a bend line transverse to the flange, creating a continuous corner flange. As an example, the present invention is useful in forming a joist hanger having a seat member, a back member connected thereto, and parallel continuous corner flanges also connecting the two members.

When a sheet metal member having one or more flanges is bent transversely to the flange or flanges such that the flanges are swung inwardly on themselves, surplus material in the flanges along and near the bend develops. This excess material wants to fold over itself or crimp.

The problems caused by excess material are particularly acute in forming and wiping dies, operating at high frequencies. For example, if the tolerances in the press are such that the flange is closely contained between the punch and the die of the press, then this surplus material in the flange can fold over itself and tear, having no where into which to flow or bend. This condition is also known as wrinkling. In such presses, the material can also become caught, causing other portions of the sheet metal member to stretch.

Wrinkling is unsightly and is often perceived as a weak spot in the part. Stretching can also create undesirable indentations in the corner of the flange. Both wrinkling and stretching are not easily controlled between parts, such that there is a lack of uniformity between the parts. The present invention seeks to create a part, having a continuous corner flange that is smooth and lacks any visible wrinkles, crimps, puckering in the portions of the flange that have been compressed, and any deleterious stretching in the portions of the part near the compressed areas of the flange. The process creates more uniform parts.

The difficulties caused by the surplus material that develops can also prematurely age the press. It is known in the prior art that excess material that develops between components of a die can cause "technical difficulties" which affects the operation of the press. See U.S. Pat. No. 1,343,647, granted to R. S. Smith in 1920 at page 1, line 37.

There are a number of ways of avoiding the difficulties associated with forming a continuous corner flange on a high-speed wiping or forming die. For example, if the transverse bend is made with a large radius, the compressed area is reduced, and tearing is less likely. Further, reducing the height of the flange or flanges also reduces the portions of the flanges to be compressed, reducing the likelihood that tearing will occur.

However, it is often desirable to form a continuous corner flange in a part having a tight-radius, 90-degree bend with relatively high side flanges. For example, the inventor, using the present method can consistently form a tight-radius, 90-degree bend with a 9/16" high continuous corner flange without wrinkling, and with only minimal stretching the material in both 12 gauge and 18 gauge material. The height of the side flange is measured away from the transverse bend line and from the back along the proximal side of the flange to the top of the flange. With regard to stretching of the material, the inventor tested parts formed in a v-shaped forming die with openings in their side flanges and without openings in their side flanges. The inventor found that with an 18 gauge part with no openings in the side flanges, the material in the very corner of the part where the transverse bend line meets the flange bend line the part was thinned by 0.08". In comparison, the inventors noticed less thinning in the same part formed with a 1/8" diameter opening located on the transverse bend line in the side flange, the opening being adjacent the edge of the curved portion in the flange that results from the transverse and flange bends. The material thinned only 0.04" in the very corner. Thinning was similarly less in side-by-side comparisons of a parts formed with 12 gauge material.

There are prior art methods of forming similar shapes in light gauge sheet metal; however, they suffer from various drawbacks. For example, forming a short-radius, 90-degree bend with a continuous corner flange could be accomplished in a draw-action die. However, draw-action dies are relatively slow compared to forming or wiping dies. Also draw action dies require excess material around the part to hold the part while it is being stretched. This excess material usually needs to be cut off the part once the drawing operation is complete, adding an extra step to the process.

A number of other patented prior art processes form a transverse bend in a sheet metal part having corner flanges, however, these methods remove most or all of the material from the side flanges that is likely to be compressed. This avoids the problem of having the excess material of the flanges near the transverse bend crimp or wrinkle on itself; however, the flange is substantially weakened by the removal of most or all of the material near the transverse bend. See U.S. Pat. No. 1,925,804, granted to William C. Hiering on Sep. 5, 1933, and U.S. Pat. No. 5,203,069, granted to Kurt Hennig on Apr. 20, 1992.

The present inventive method for laterally bending an elongated sheet metal member having one or more side flanges treats the above problems, preventing tearing or undue stretching of the metal of and around the flanges without removing excessive amounts of material from the flanges near the transverse bend, or using a slower draw method, or reducing the height of the flanges or reducing the sharpness of the transverse bend.

The method of the present invention is particularly suited for forming certain types of sheet metal joist hangers. Sheet metal joist hangers are widely used in wood frame construction to attach joists to carrying members. The method of the present invention has particular relevance for forming light gauge hangers having an upright back with parallel opposed side flanges extending therefrom, and a flanged horizontal seat extending outwardly from the back in the same direction as the flanges to form a bearing area for a joist. See U.S. Pat. No. 4,802,786 granted to James G. Yauger and John M. Rushton on Feb. 7, 1989 for an example of such a hanger. U.S. Pat. No. 3,633,950, granted to Tyrell T. Gilb on Jan. 11, 1972 is also exemplary.

The particular joist hangers described in the two above-identified patents are used in the panelized roofing industry, where large roofs are normal, requiring the use of hundreds of such hangers at a time. Currently, many industrial buildings are designed with panelized roofs, creating a high demand for such hangers. The present invention provides an economic method for forming the critical transverse bend in such hangers between the back member and the seat.

SUMMARY OF THE PRESENT INVENTION

It is an object of the present invention to form a bend in a sheet metal member having one or more flanges, the bend being transverse to the flange or flanges, without causing a wrinkling or buckling of the material of the flanges in the compressed areas.

It is a further object of the present invention to form a transverse, short-radius bend in an elongated sheet metal member having one or more flanges, creating continuous corner flanges free from wrinkles or puckering.

It is a further object of the present invention to form a transverse, tight-radius bend in an elongated sheet metal member having one or more flanges that are relatively high, creating wrinkle-free, continuous corner flanges.

It is a further object of the present invention to form a bent sheet metal member having a tall side flange with minimal deformities such that the connection of the flange across the bend line is substantial.

It is a further object of the present invention to form a folded sheet metal member having a tall side flange on a high-speed forming die.

These objects are accomplished by providing one or more openings in the portions of the areas of the flanges that are bent inwardly and would otherwise buckle or fold on themselves if the openings were not there. The openings allow for the controlled flow of material of the compressed side flanges during the formation of the critical transverse bend. Controlling the flow of the material into the openings prevents wrinkling of the material of the flanges and wear on the press.

According to the present invention, one or more closed perimeter openings are formed in the compression areas of the flanges. The flanges are bent inwardly on themselves during the bending of the web portion of the part along the transverse bend line. Because of the force at which the inward bending occurs, and because portions of the side flanges are supported on their distal and proximal side, the material of the side flanges in the compression area plasticizes and flows into the closed perimeter opening, causing them to deform. Because the closed perimeter opening or openings are present, the side flanges are compressed in a more controlled manner, reducing cracking, wrinkling and thinning during the final bending of the web of the part.

This method is particularly useful for shaping metal members as light as 18 gauge. It has also been used on sheet material as thick as 12 gauge.

The method of the present invention improves upon existing methods by forming the short-radius, 90-degree bend in flanged metal member without wrinkling. As it is the wrinkling of the metal that prematurely ages the die components, use of the method of the present invention allows the manufacturer to go longer before the die components have to be replaced.

The present invention is particularly useful for manufacturing a flanged joist hanger having an upright back member and a seat member formed out of the back member by a sharp-radius bend. The blank is provided with two or more openings. These openings are formed in the flanges at or near the transverse bend line where the seat will be formed from the back member. Preferably, the openings formed in the blank are separated by the width of the web plus additional material on either side of the web, and are separated from what will be the edges of the flanges. In the preferred method of the present invention, the flanges are then formed, and finally the transverse bend at or near the openings.

Use of the method of the present invention to form a channel-shaped, light-gauge joist hanger on a high-speed progressive press also reduces the work that needs to be performed on the part. Use of the inventive method allows the press to be operated at a lower tonnage than with traditional methods that wipe the channel-shaped part to create the critical transverse bend. The inventor found that it took 750 pounds per square inch less pressure to form tight-radius, 90 degree bend in a 12 gauge channel-shaped member having openings in the side flanges in the compression zone in a v-shaped forming press, over a channel-shaped member having no such openings. It only took pressure of 2750 pounds per square inch to form a 12 gauge member according to the present invention with closed perimeter openings in the flanges.

DESCRIPTION OF THE PREFERRED EMBODIMENT OF THE INVENTION

Figure 1:
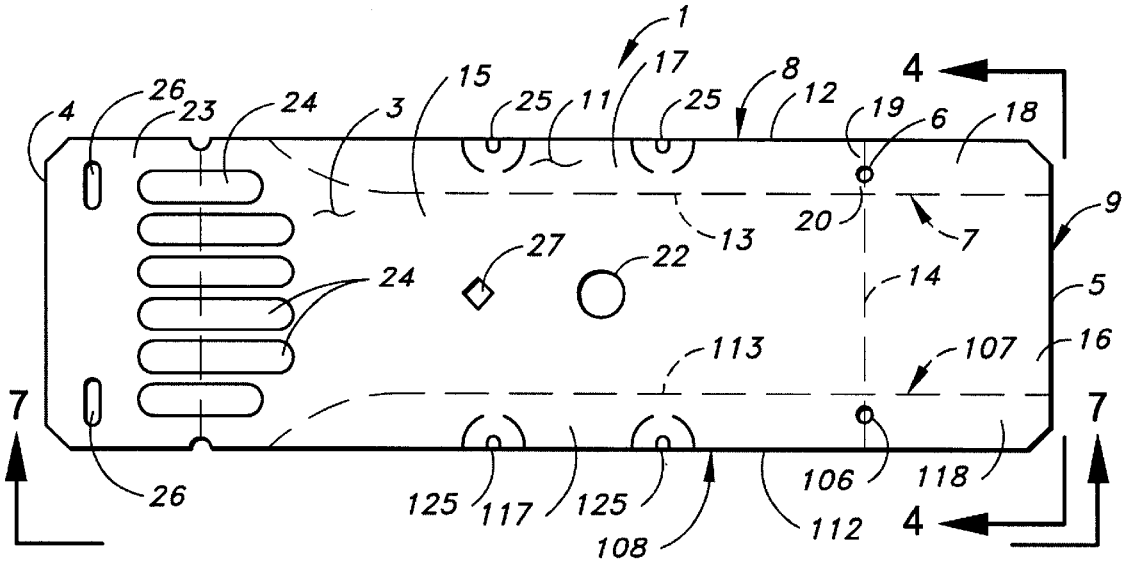
FIG. 1 is a top plan view of a blank from which a joist hanger can be formed according to the method of the present invention. The blank is shown as already being cut from a coil of sheet metal and with any openings, notches and embossments already formed therein. As is well-known in the art, the blank would not be completely cut from the coil if the part were to be formed on a progressive press as is the preferred method for the present invention.

With reference to FIG. 1, the method of the present invention is performed on a piece 1 of bendable sheet material having a distal side 2, a proximal side 3 and first and second ends 4 and 5. In the first step of the process, a closed perimeter opening 6 is formed in the piece 1. The closed perimeter 6 opening has a first shape.

Figure 2:
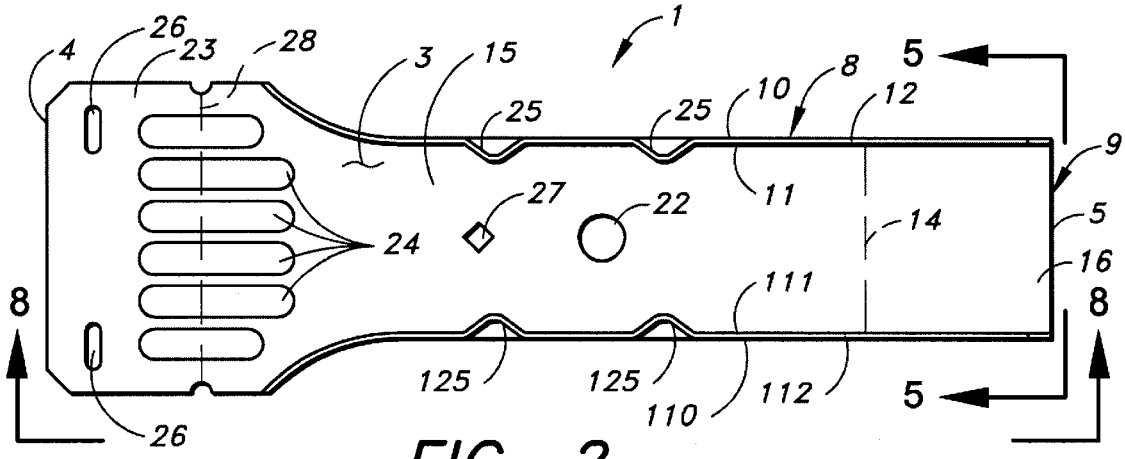
FIG. 2 is a top plan view of the same part of FIG. 1 after side flanges have been formed in the part.

Next the piece 1 is bent along a flange bend line 7 so that the piece 1 adopts a first intermediate position. See FIG. 2. The flange bend line 7 divides the piece 1 into a flange 8 that contains the closed perimeter opening 6 and a web 9 to the other side of said flange bend line 7. The flange 8 has distal and proximal sides 10 and 11 corresponding to the distal and proximal sides 2 and 3 of the piece 1. The flange 8 also has a top 12 disposed away from the flange bend line 7 and a bottom 13 coincident with the flange bend line 7.

Figure 3:
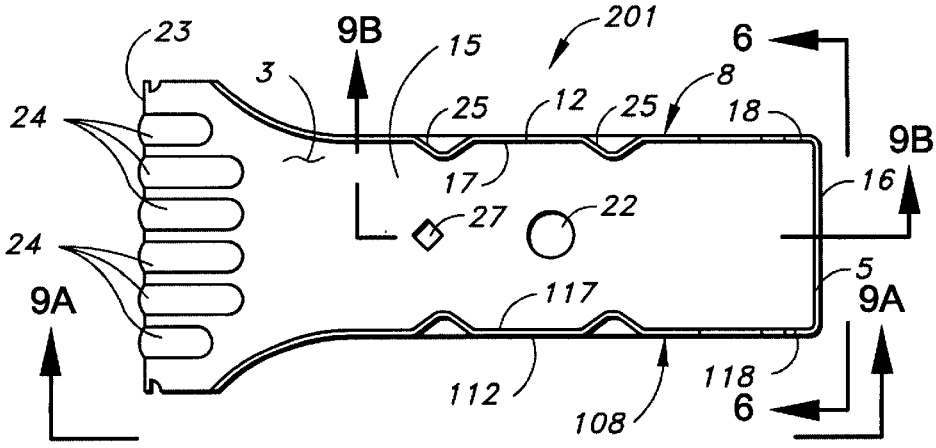
FIG. 3 is a top plan view of the same part of FIG. 1 after the final bends have been made. A top flange has been formed by means common in the art and a seat member has been formed according to the method of the present invention. The closed perimeter openings in the side flanges along the transverse bend line have been narrowed to slits due to the flow of plasticized metal during the forming of the final transverse bend.
Figure 4:
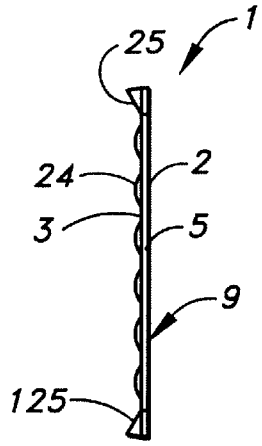
FIG. 4 is an end view of the blank of FIG. 1 taken along view line 4—4 of FIG. 1.
Figure 12:
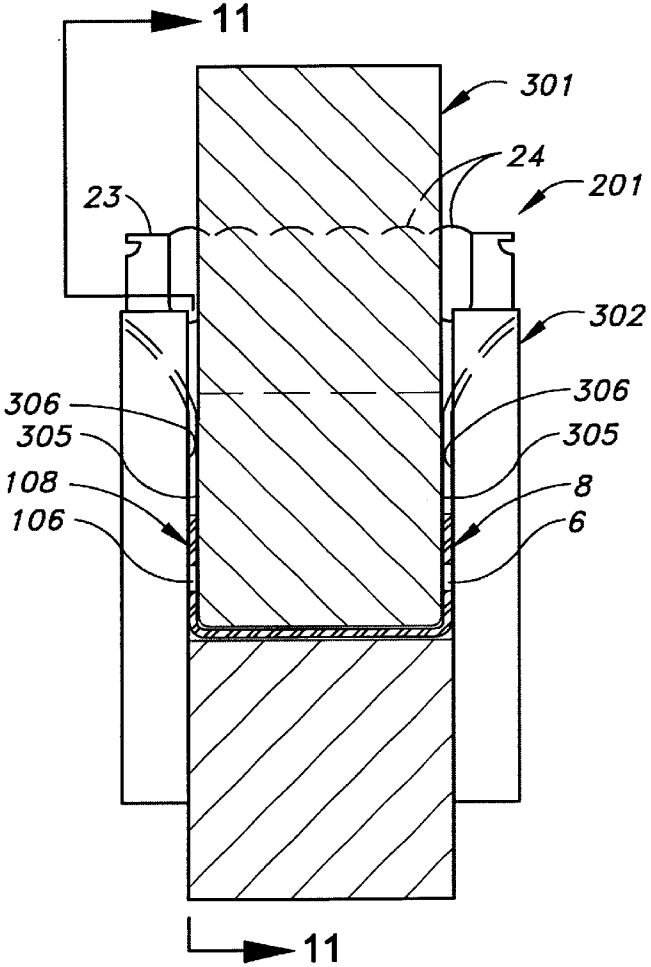
FIG. 12 is a sectional view of the press shown in FIGS. 10 and 11 taken along section line 12—12 of FIG. 11. The finished part is shown in cross-section as well.
Figure 11:
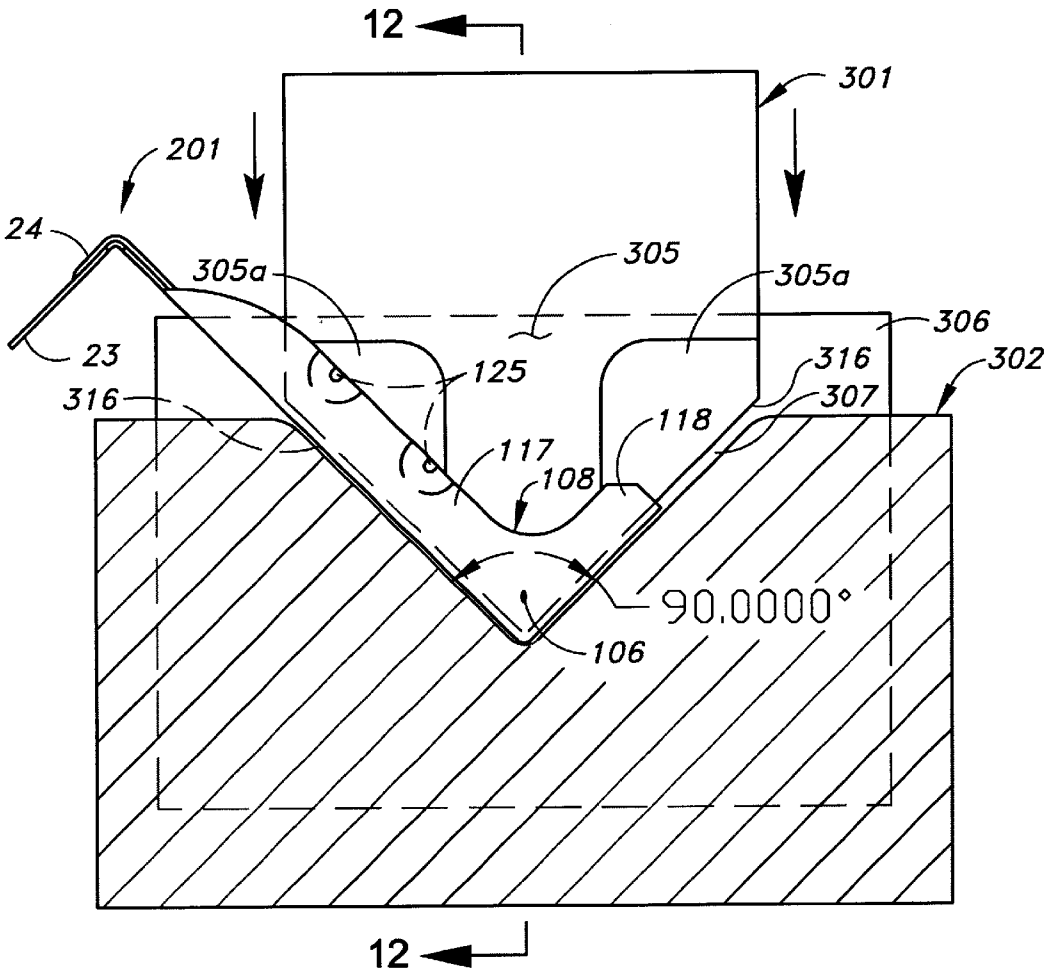
FIG. 11 is a sectional, side view of the same press of FIG. 10 taken along view line 11—11 of FIG. 12. The view shows the punch at the bottom of its stroke having formed the transverse bend according to the present invention in the part.

To complete the inventive method, the web 9 is bent along a transverse bend line 14 that divides the web 9 into a back 15 and a seat 16 and the flange 8 into a back flange 17 and a seat flange 18, so that said piece adopts a second position. See FIGS. 3, 11 and 12. The transverse bend line 14 lies near the closed perimeter opening 6. While bending the web 9 along the transverse bend line 14, portions of the distal and proximal sides 10 and 11 of the flange 7 are supported such that the seat flange 18 and the back flange 17 are swung inwardly on each other, such that portions of the seat flange 18 and the back flange 17 near the ends 4 and 5 of the part are bent out of line and lie at an angle to each other. The bending of the web 9 along the transverse bend line 14 is carried out with a force sufficient to create compression forces in portions of the flange 8 near the transverse bend line 14, causing portions of the flange 8 to plasticize and flow into the closed perimeter opening 6 in the flange 8, such that the closed perimeter of the opening 6 is deformed by the material flow and the opening 6 adopts a second smaller shape than the first shape.

As shown in FIG. 1, the preferred first shape of the closed perimeter opening 6 is a circle having a diameter of ⅛". Such an opening 6 is preferred for forming continuous corner flanges in both 12 gauge and 18 gauge metal. Other shapes are possible, but a circle is preferred. The closed perimeter opening 6 can be made with a first shape that is a polygon. However, the sharp angles in a polygon are more likely to be the point where a tear begins during failure of the part when a load is placed on the part. Thus, shaping the closed perimeter opening 6 as a continuously curving member is preferred.

The closed perimeter opening 6 is preferably formed in the compression area caused by the inward swinging of the back flange and seat flange portions 17 and 18, just above or adjacent to any curved portions in the side flange 8 due to bending the part along the flange bend line 7 or the transverse bend line 14.

As it is the bending of the side flange 8 along the transverse bend line 14 that creates compression areas in the side flange 8 where the metal wants to accumulate due to material flow, the closed perimeter opening 6, according to the present invention must be located in the compression area such that it is transected by the transverse bend line 14 or must be located near the transverse bend line 14, such that plastic flow will deform the opening 6. In the preferred embodiment, the closed perimeter opening 6 in the compression area is bisected by the transverse bend line 14.

In the preferred embodiment the closed perimeter opening 6 is also located closer to the web 9 or the flange bend line 7, rather than to the top 12 of the flange 8. This makes for a stronger flange 8.

When only one closed perimeter opening 6 is used, ideally it will be spaced away from both the top 12 of the flange 8 and the flange bend line 7 by continuous material zones 19 and 20. See FIG. 1. The continuous material zones 19 and 20 consist of areas made up of lines running substantially perpendicular to the flange bend line 7 between the closed perimeter opening 6 and the top 12 and bottom 13 of the flange 8 in the first intermediate position.

The flange bend line 7 could be a tangent of the closed perimeter opening 6, but this is not preferred.

The continuous material zone 19 above the closed perimeter opening 6 can also be described in the following manner: it has an upper limit defined by the top 12 of the flange 8, a lower limit defined by the top edge of the closed perimeter opening 6 and boundaries on either side defined by lines orthogonal to the flange bend line 7 and tangent to the closed perimeter opening 6 at the outermost opposed points of the perimeter of the closed perimeter opening 6 along the flange bend line 7 when the part is in the first intermediate position. The lower continuous material zone is defined similarly, except with reference to bottom 13 of the flange 8.

This upper continuous material zone 19 has a width defined as the distance between the top 12 of the flange 7 and the closest point on the perimeter of the closed perimeter opening 6 to the top 12 of the flange 8. Ideally this width is greater than the thickness of the material from which the piece 1 is made.

Figure 13A:
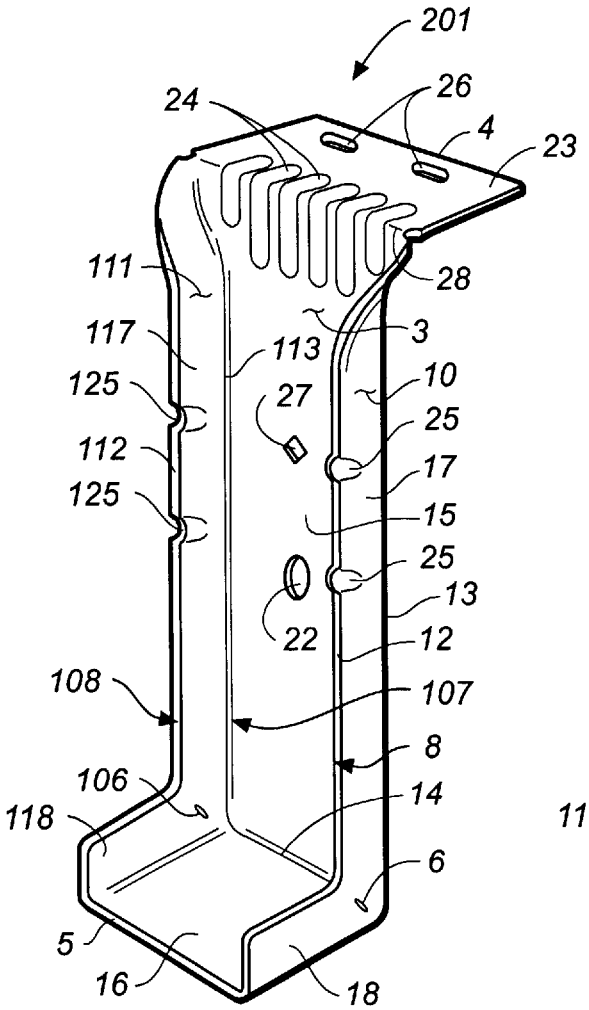
FIG. 13A is a perspective view of the finished joist hanger of FIG. 3 formed according to the present invention.
Figure 13B:
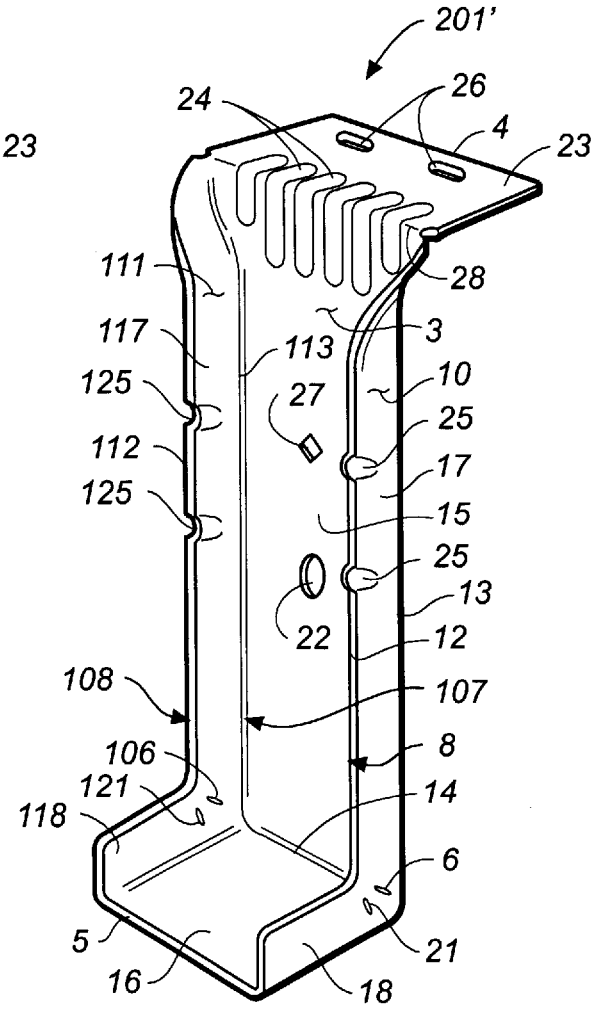
FIG. 13B is a perspective view of the finished joist hanger of FIG. 16 formed according to the method of the present invention. The joist hanger of FIG. 13B differs from FIG. 13A only in that it is formed with a plurality of openings near the transverse bend for allowing the plasticized metal of the flanges in the compressed areas to flow freely during the forming of the transverse bend.
Figure 14:
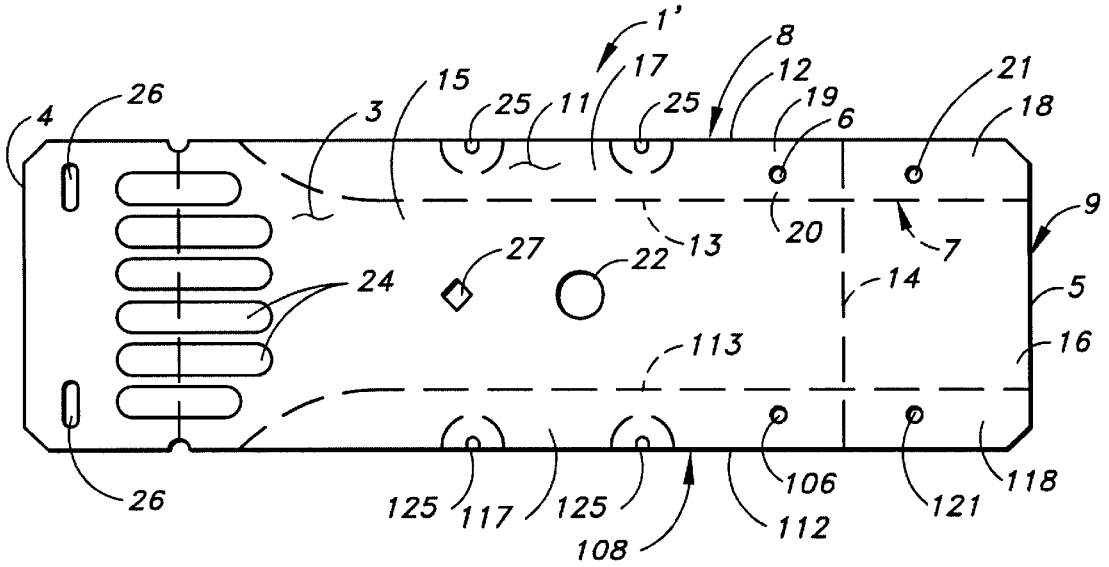
FIG. 14 is a top plan view of another blank from which a joist hanger can be formed according to the method of the present invention. The blank is shown as already being cut from a coil of sheet metal and with any openings, notches and embossments already formed therein. In this blank for a joist hanger two openings are formed in each side flange. The openings in each flange straddle the transverse bend line.
Figure 15:
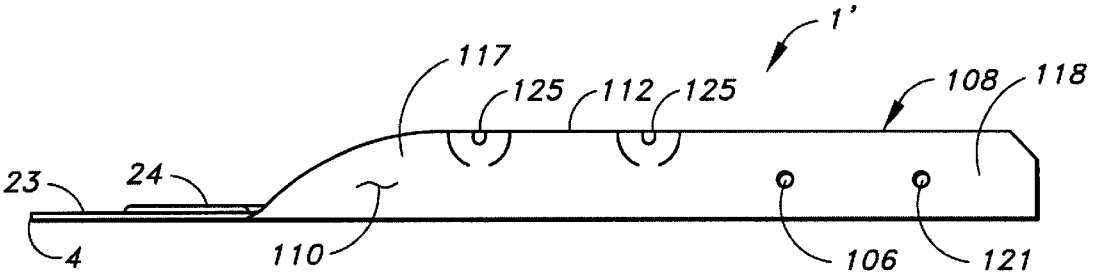
FIG. 15 is a side view of the same part of FIG. 14 after side flanges have been formed in the part.
Figure 16:
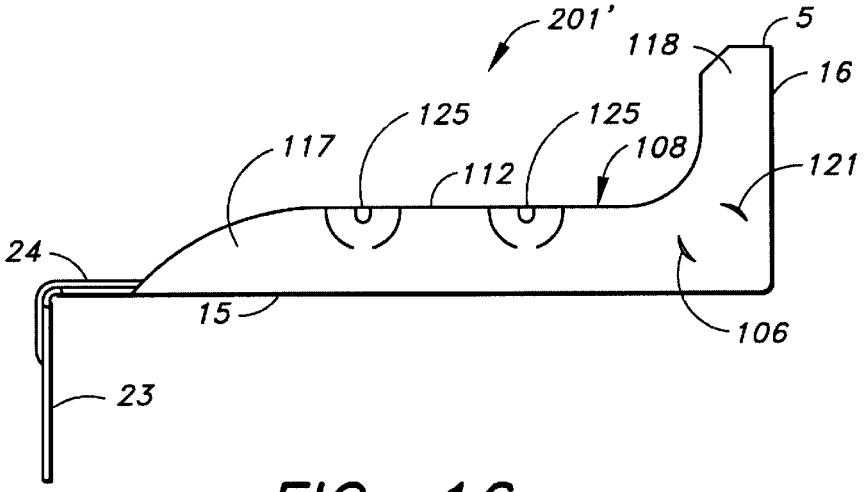
FIG. 16 is a side view of the same part of FIG. 14 after the final bends have been made. A top flange has been formed by means common in the art and a seat member has been formed according to the method of the present invention.
Figure 17:
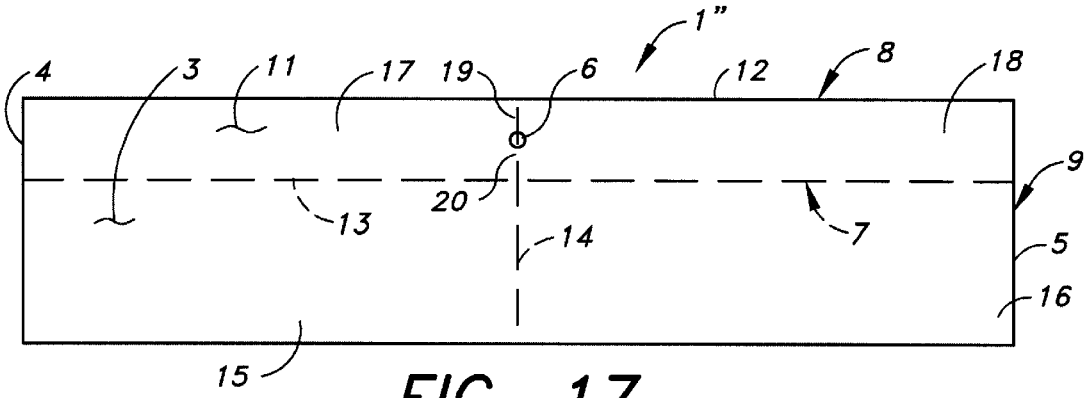
FIG. 17 is a top plan view of a sheet metal blank. This blank is provided with a bend line to form a single side flange and another bend line for making a transverse bend in the part. The bend lines are shown in phantom. Since the part formed from the blank will have only one side flange, only one opening is formed in the part to accommodate the flow of plasticized metal, during the formation of the transverse bend.
Figure 18:
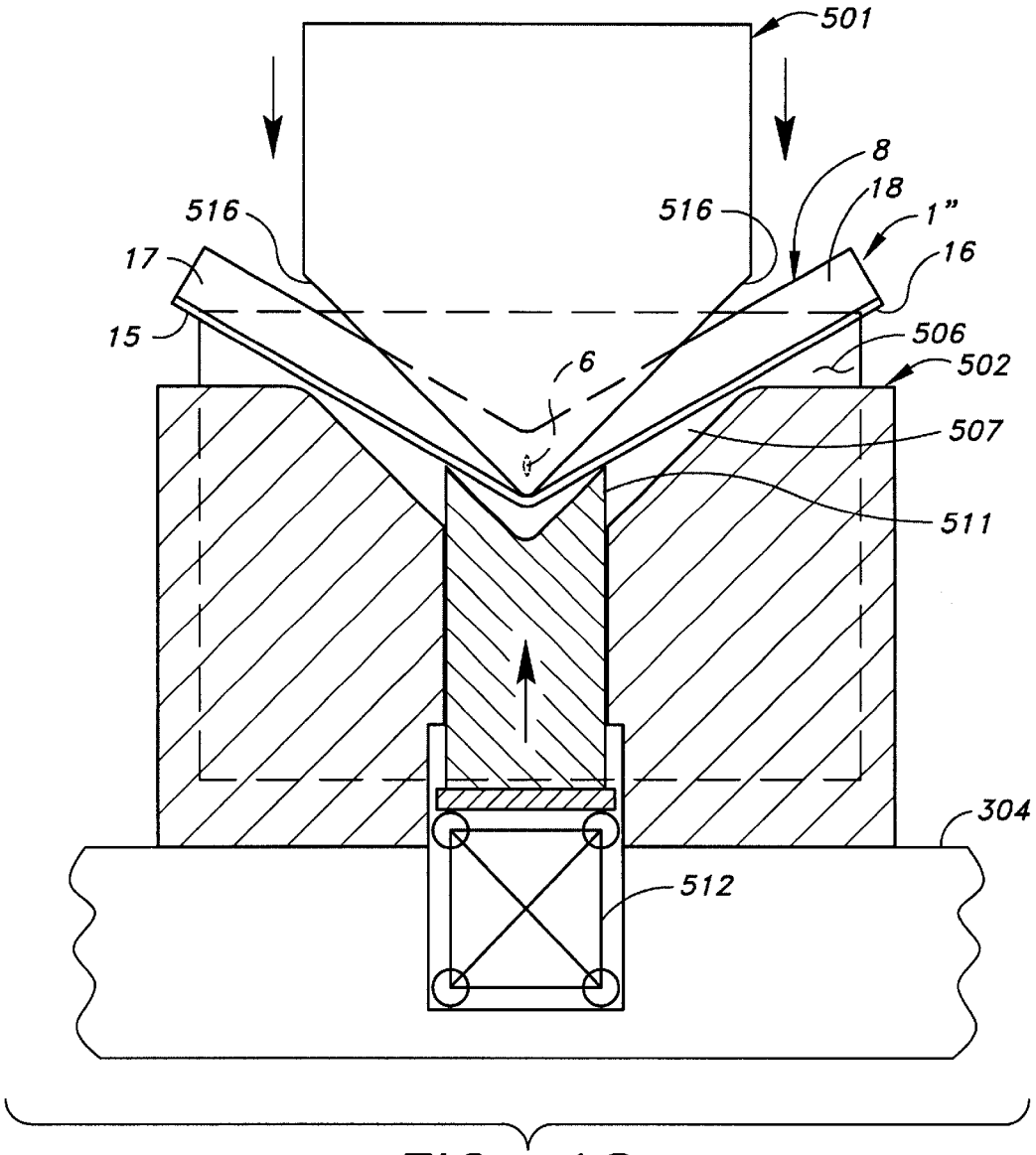
FIG. 18 is a sectional side view of a press used to form the transverse bend according to the present invention in a sheet metal part having only a single side flange. The movable upper punch is shown nearing the completion of its stroke. The sheet metal part is disposed between the moving punch and the stationary die. The transverse bend in the part has been partially formed. The opening in the compression area of the side flange has already narrowed to an oval due to the flow of plasticized metal. The lower die is shown with a knock-out plate or lifter that holds the part as the punch moves through its downward stroke.
Figure 20:
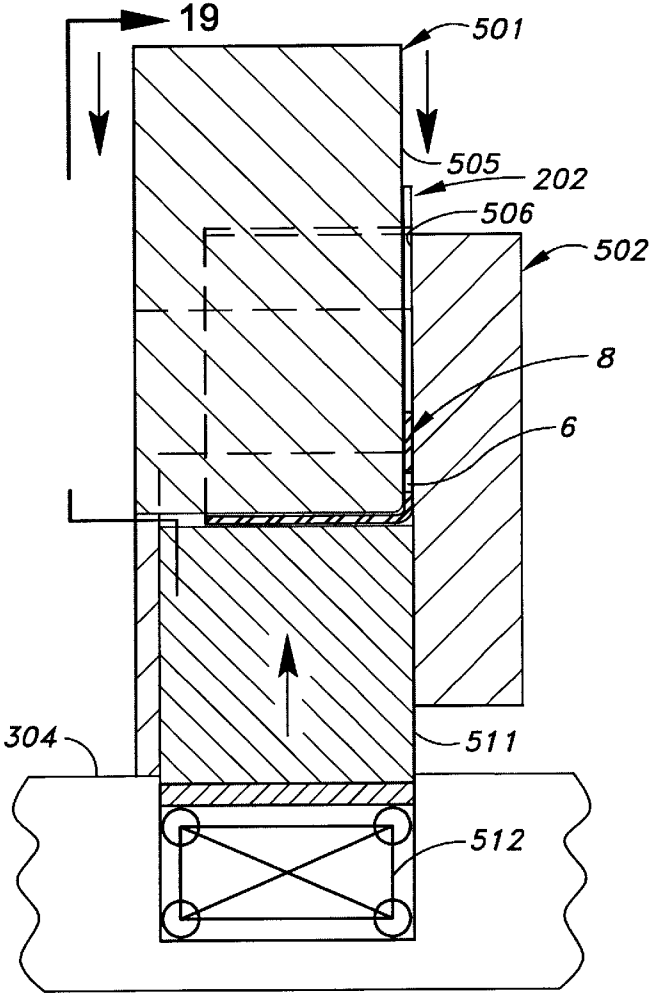
FIG. 20 is a sectional view of the press of FIG. 18 taken along section line 19—19.
Figure 19:
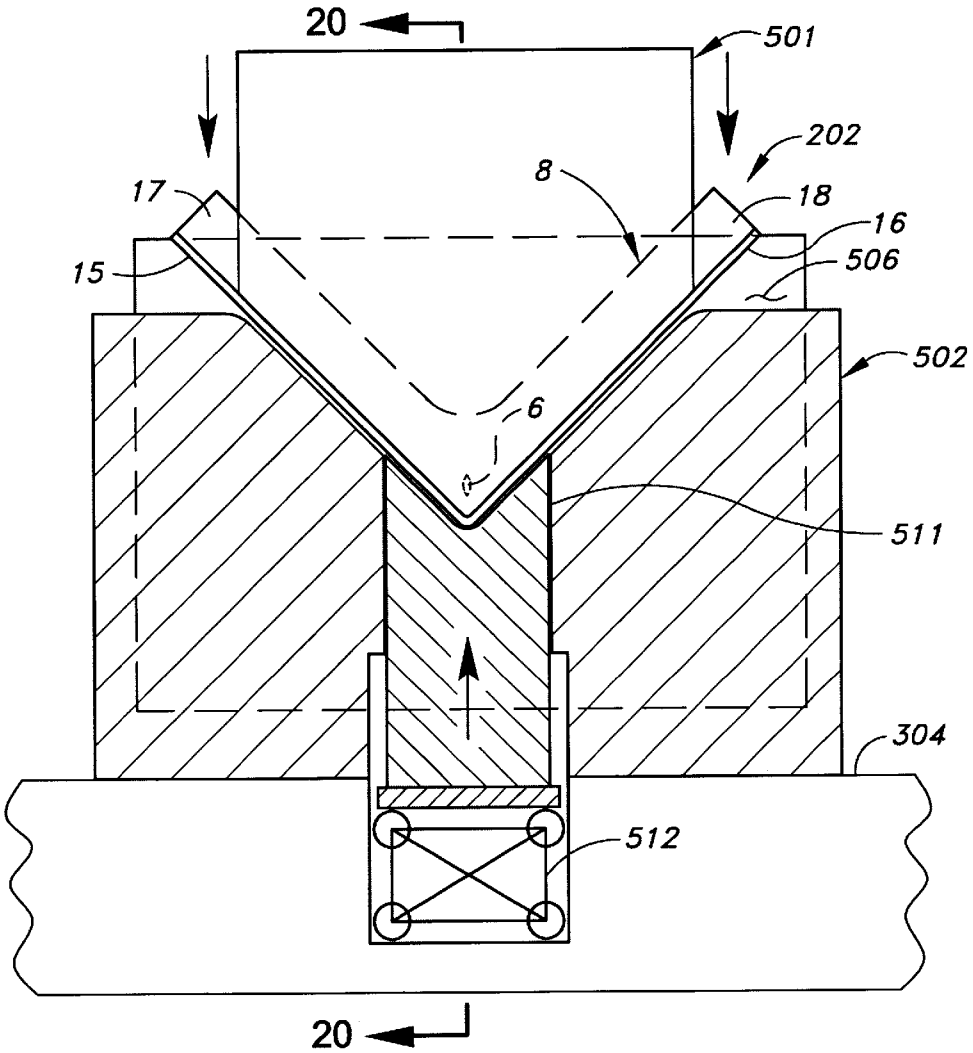
FIG. 19 is a sectional side view of the die of FIG. 18. The upper movable punch is shown having completed its downward stroke. The part is shown with the transverse bend having been completely formed.
Figure 22:
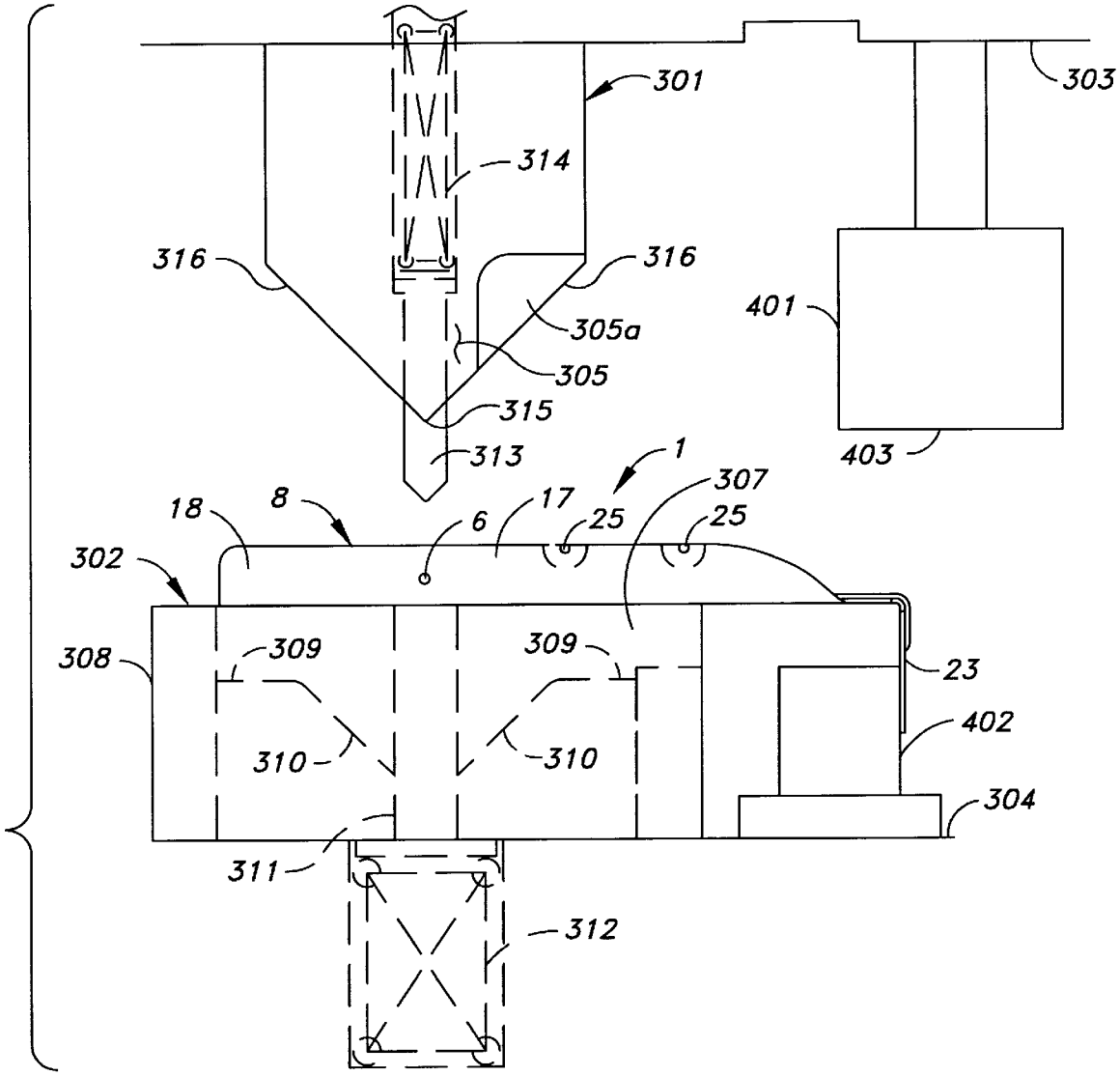
FIG. 22 is a side view of a station in a progressive press used to form the transverse bend according to he present invention in a sheet metal part. The station shown is actually the last station in a progressive press. At this station, both the final transverse bend is formed in the part and the part is cut from sheet metal coil. The station is shown with the punch press and cutter press at the top of their stroke and the part having just been inserted into the station. Portions of the punch press and punch die are shown in phantom lines to illustrate the station better.
Figure 21:
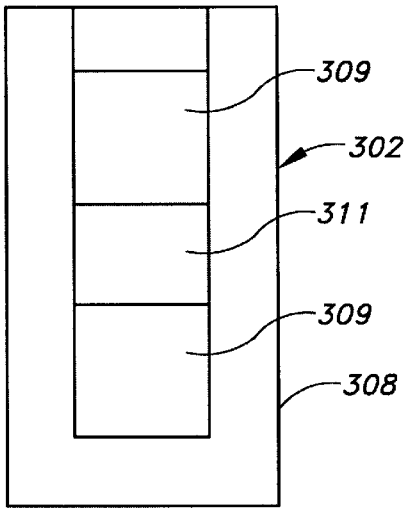
FIG. 21 is top plan view of punch die for making the transverse bend in a part according to the present invention. The punch die shown is particularly useful for forming the part on a progressive press.
Figure 23:
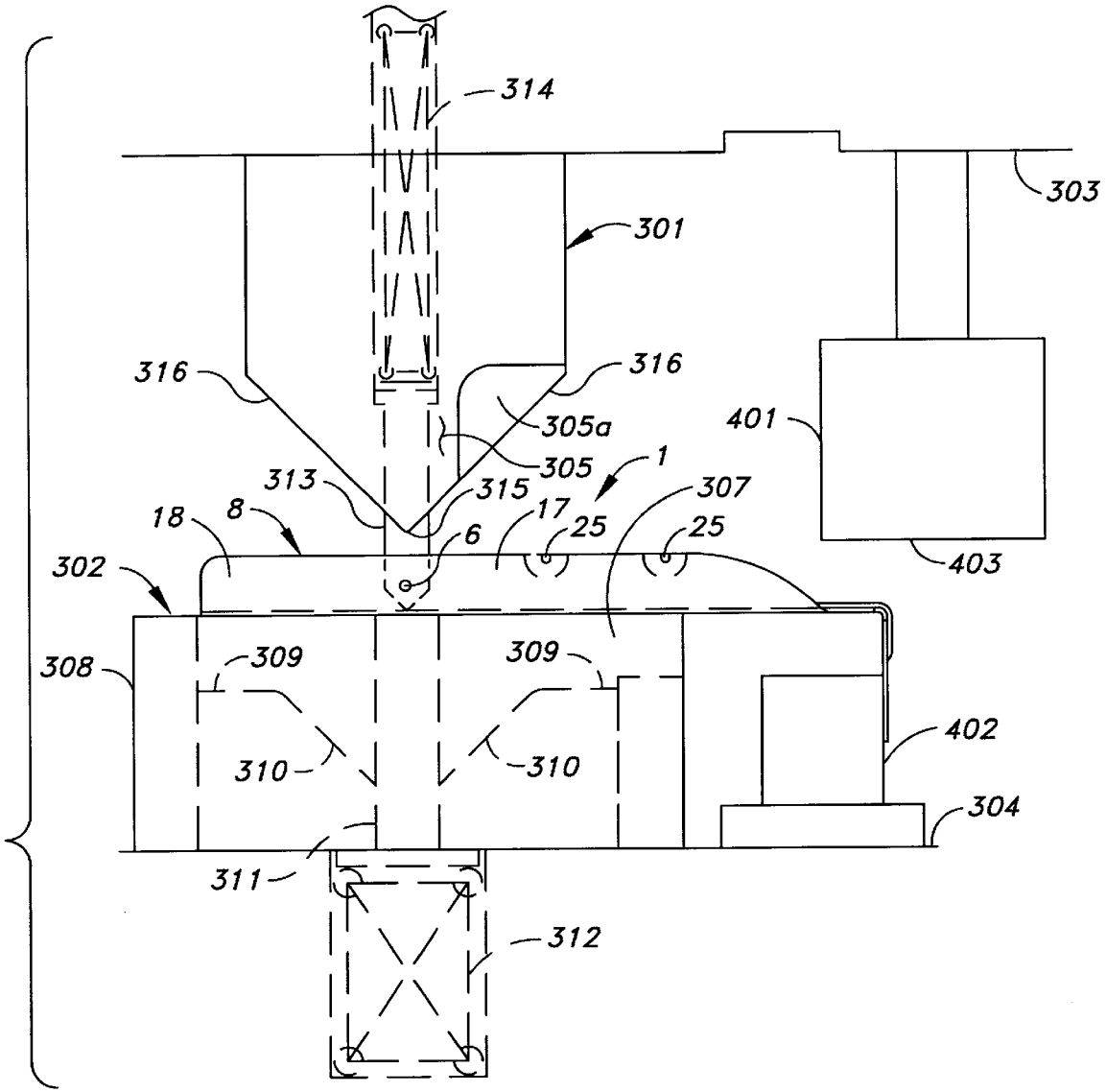
FIG. 23 is a similar view to FIG. 22 of the last station in a progressive press where the part is cut from the coil and the transverse bend is formed. The station is shown with the punch press and cutter press beginning their downward stroke. The part is shown pinched between the ejector pin and the lifter.
Figure 24:
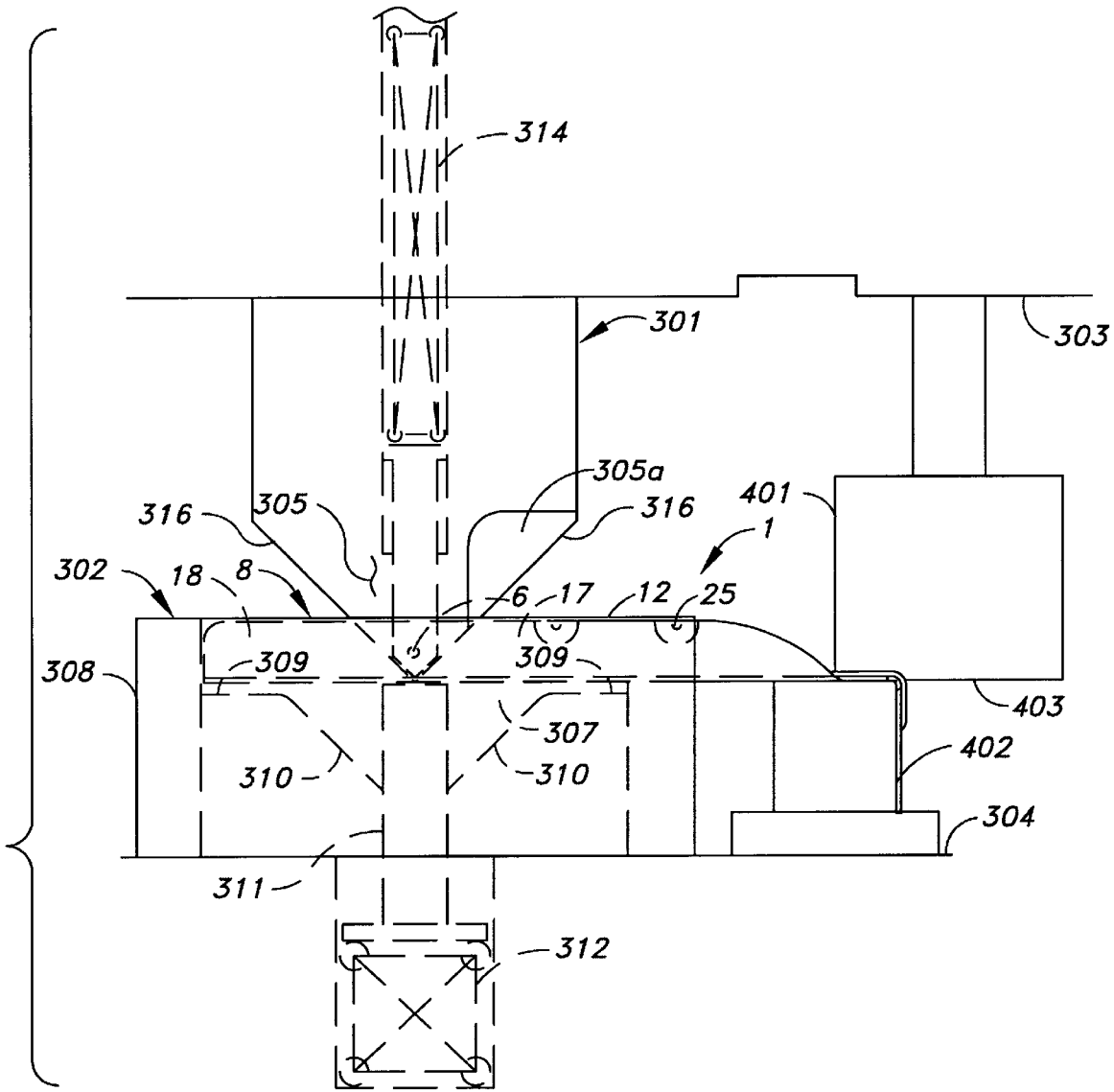
FIG. 24 is a similar view to FIG. 22 of the last station in a progressive press where the part is cut from the coil and the transverse bend is formed. The station is shown with the punch press and cutter press well into their downward stroke. The punch press has made contact with the part. The ejector pin is now completely encapsulated in the punch press, and the cutter press has cut the part from the coil.
Figure 25:
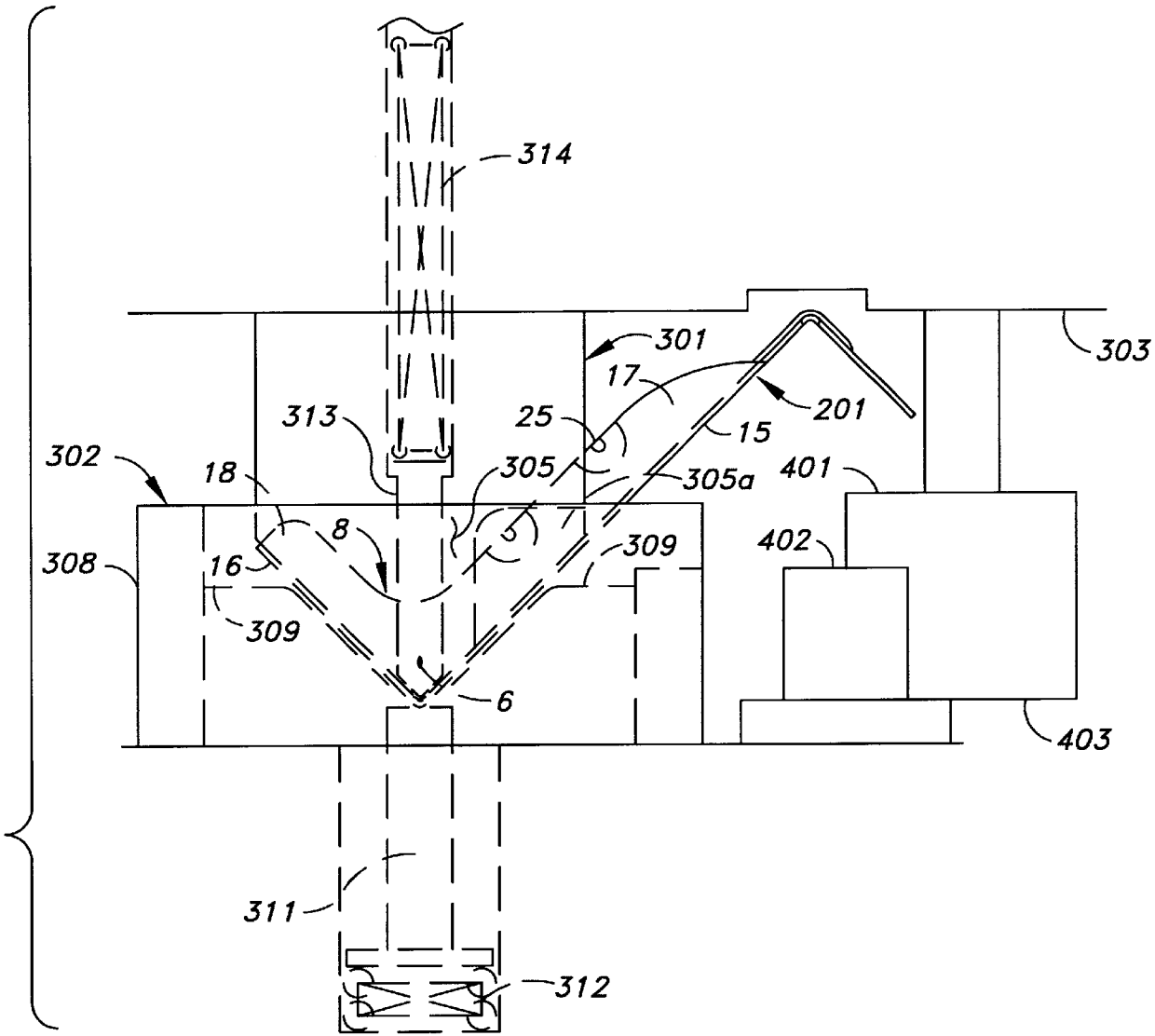
FIG. 25 is a similar view to FIG. 22 of the last station in a progressive press where the part is cut from the coil and the transverse bend is formed. The station is shown with the punch press and cutter press at the bottom of their downward stroke. The part has been bent along the transverse bend line, adopting its final shape.

In the preferred embodiment, a majority of the material of the flange 8 lies in a first plane after the piece 1 has adopted its first intermediate position, and after the piece 1 has been shaped into its second position, the majority of the material of the flange 8 still lies in that first plane. See FIGS. 2 and 13*a*.

Even if the majority of the material of the flange 8 does not lie in a first plane, under the present invention, the back flange 17 will lie at a selected angle or orientation to the back 15 and the seat flange 18 will lie at a selected angle or orientation to the seat 16, and the back and seat flanges 17 and 18 will retaining those orientation to the back 15 and seat 16 throughout the process of forming the transverse bend.

In this preferred case where the substantial portion of the flange 8 lies in a single plane, that plane is at 90 degrees to the web 9, such that the back flange 17 is 90 degrees to the back 15 and the seat flange 18 is 90 degrees to the seat 16.

Figure 5:
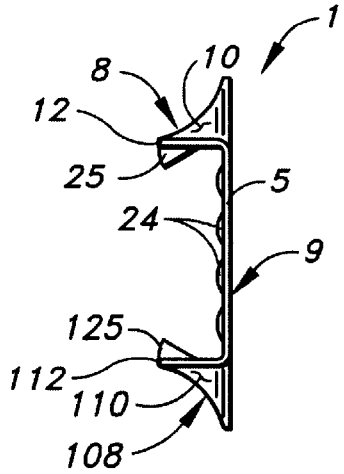
FIG. 5 is an end view of the part of FIG. 2 taken along view line 5—5 of FIG. 2.
Figure 6:
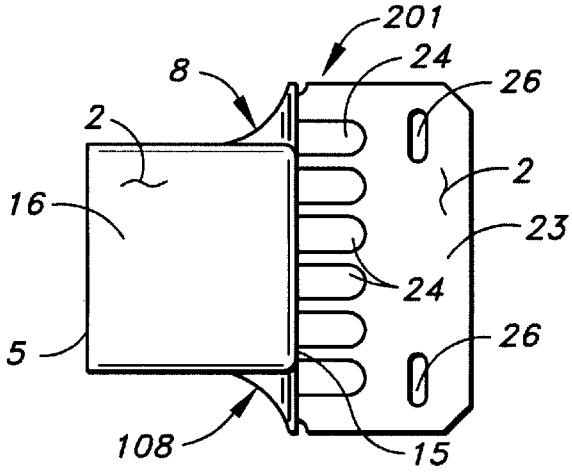
FIG. 6 is an end view of the finished part of FIG. 3 taken along view line 6—6 of FIG. 3.
Figure 7:
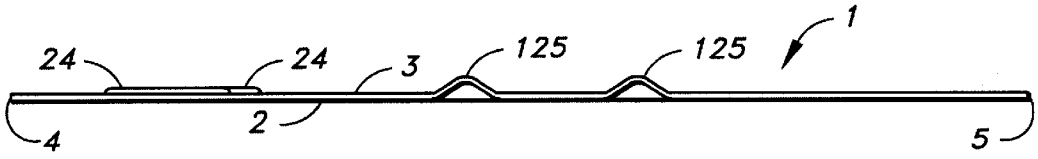
FIG. 7 is a side view of the part of FIG. 1 taken along view line 7—7 of FIG. 1.
Figure 8:
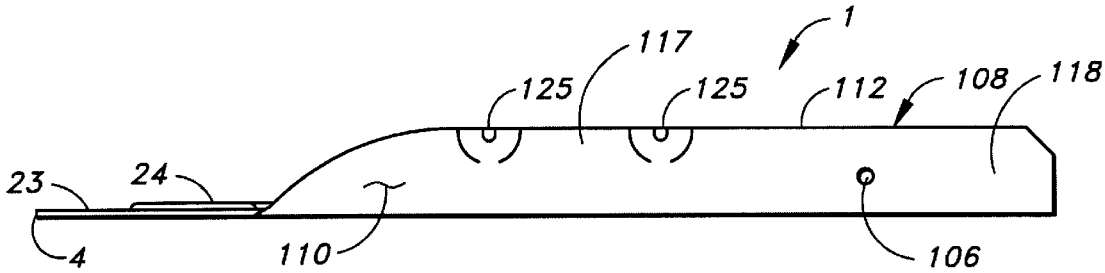
FIG. 8 is a side view of the part of FIG. 2 taken along view line 8—8 of FIG. 2.

Since in the preferred form, all bends are made with tight-radius bends, the substantial majority of the flange 8 when viewed in cross section near the transverse bend line 14 will be planar and only the portion near the flange bend line 7 will be curved. See FIGS. 5, 6 and 12.

While it is preferred that only one closed perimeter opening 6 be formed in the side flange 8 near the transverse bend line 14, a plurality of openings can be formed in the side flange 8 near the transverse bend line 14. See FIGS. 13B through 16. For example, an additional closed perimeter opening 21 can also be made in the piece 1'. Preferably, the additional closed perimeter opening 21 also has the same first shape. The additional closed perimeter opening 21 is located in the flange 8 near the transverse bend line 14. The first and additional closed perimeter openings 6 and 21 lie substantially similar distances from where the transverse bend line 14 and the flange bend line 7 intersect.

The additional closed perimeter opening 21 is also located close enough to the transverse bend line 14 such that the additional closed perimeter 21 opening is also deformed by material flow. The additional closed perimeter opening 21 will also take on a second smaller shape than its first shape, after the bending along the transverse bend line 14 has taken place.

When two closed perimeter openings 6 and 21 are formed in a single flange 8, preferably the two closed perimeter openings 6 and 21 are spaced along the flange bend line 7 equal distances from the transverse bend line 14, and equal heights above the flange bend line 7.

As mentioned above, preferably the first and additional closed perimeter openings 6 and 21 are formed with the same first shape. However, in embodiments where more than one closed perimeter opening 6 is formed, said closed perimeter openings do not need to be formed with the same first shape. Further, since the material flow cannot be perfectly controlled, the second, finished shape adopted by the closed perimeter openings will not be the same among the openings even if they are formed with the same first shape. Although, the preferred first shape has been selected such that material flow almost completely closes or fills-in the closed perimeter opening such that the second shapes adopted by the closed perimeter openings are similar.

While it is preferred that the closed perimeter opening 6 be formed in the sheet material blank before any bends are made in the material, the operation of forming the closed perimeter opening 6 in the flange 8 can occur after the flange 8 has been formed by bending the piece along the flange bend line 7.

Additional steps can be added to the preferred method described above to create a part 1 having two side flanges 8 and 108 formed according to the present invention. See FIG. 1. First, a second closed perimeter opening 106 is formed in the piece 1 simultaneously with the closed perimeter opening 6 by piercing the part 1. The second closed perimeter opening 106 is formed with a first shape. Next, the piece 1 is bent along a second flange bend line 107 that has a portion substantially parallel to the flange bend line 7 simultaneously with the bending along the flange bend line 7. As with the first flange bend line 7, the second flange bend line 107 divides the piece into a second flange 108 that contains the second closed perimeter opening 106 and the web 9 to the other side of the second flange bend line 107. The second flange 108 also has distal and proximal sides 110 and 111, a top 112 disposed away from the second flange bend line 107 and a bottom 113 coincident with the second flange bend line 107. As with the first flange 7, when the piece 1 is bent along the transverse bend line 14 that divides the web 9 into a seat 16 and a back 15 and the flange 8 into a seat flange 18 and a back flange 17, the transverse bend line 14 also divides the second flange 107 into a second seat flange 118 and a second back flange 117. The transverse bend line 14 also lies near the second closed perimeter opening 106.

When the piece 1 is bent along the transverse bend line 14, portions of the distal and proximal sides 110 and 111 of the second flange 108 are simultaneously supported such that the second seat flange 118 and the second back flange 117 are swung inwardly on each other, such that portions of the second seat flange 118 and the second back flange 117 near the ends 4 and 5 of the part 1 are bent out of line and lie at an angle to each other. The bending of the piece 1 along the transverse bend line 14 occurs with a force sufficient to create compression forces in portions of the second flange 108 near the transverse bend line 14, causing portions of the second flange 108 to plasticize and flow into the second closed perimeter opening 106 in the second flange 108, such that the closed perimeter of the second opening 106 is deformed by the material flow and the second closed perimeter opening 106 adopts a second smaller shape than the first shape.

Figure 9A:
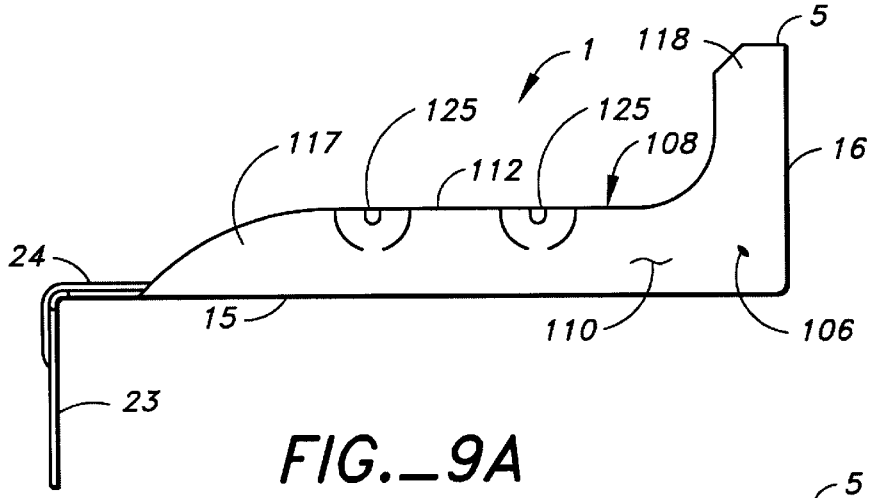
FIG. 9A is a side view of the finished part of FIG. 3 taken along view line 9A—9A.
Figure 9B:
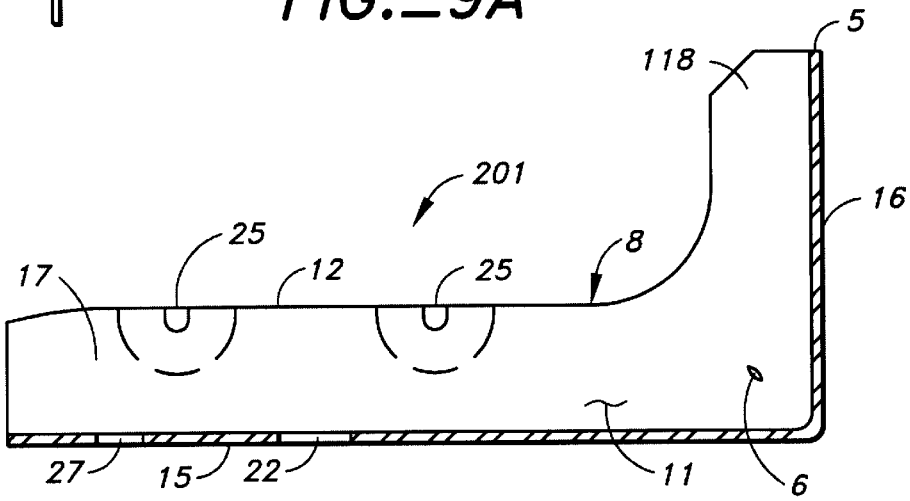
FIG. 9*b* is cross-section of the finished part of FIG. 3 taken along section line 9B—9B.
Figure 10:
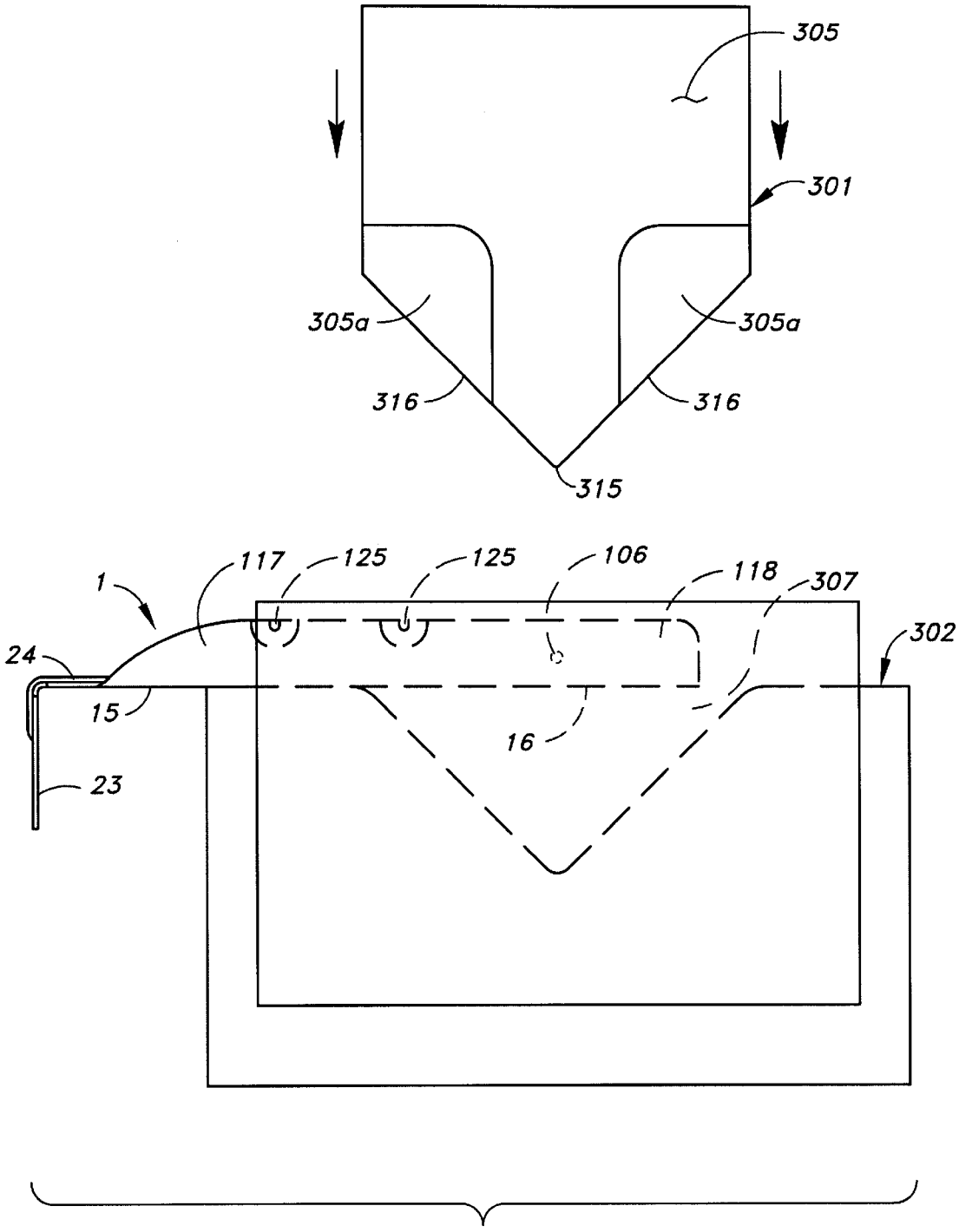
FIG. 10 is side view of a press used to form a transverse bend according to the present invention in a sheet metal part. The part created will be the finished joist hanger shown in FIG. 3. The part is shown resting on the upper surfaces of the die, and the punch is shown in the raised position prior to its downward stroke.

Also in the preferred embodiment, the bends occurring along the flange bend lines 7 and 107 and the transverse bend line 14 are tight-radius, 90 degree bends, having a radius equal to the thickness of the material. This radius is measured as the distance from the axis about which the bend is formed and the proximal side 2 of the piece 1. See FIG. 9*b*.

Although it is not preferred the second flange 108 can be formed with a second closed perimeter opening 106 and an additional closed perimeter opening 121.

The following description relates the process of forming a fold or transverse bend in a channel-shaped member to create a primarily "L-shaped" channel member that can be used as the joist receiving portion of a hanger 201.

It will be understood by those skilled in the art, that the same process with slight adaptations can be used to create a sheet metal member 202 having a base or web 9 portion and only one side flange disposed at an angle thereto. Those of ordinary skill in the art will also recognize that the inventive method is equally applicable to innumerable other articles having bends transverse to continuous corner flanges. It is also to be noted that all the bends formed according to the preferred method are tight-radius, 90 degree bends; however, it is not essential to the invention that the side flanges 8 and 108 be disposed normal to the web member 9 for purposes of the invention, nor is essential that the transverse bend itself create two members disposed orthogonally to each other. Further, the transverse bend line 14 need not be normal to the flange bend lines 7 and 107.

The preferred method of forming a light-gauge, channel-shaped hanger 201 with a tight-radius transverse bend on a high-speed progressive press according to the present invention consists of the following steps.

To initiate the process, the leading edge of a coil of sheet metal is fed into a progressive press. Progressive presses are well-known in the art for forming light-gauge sheet metal members having multiple bends. For forming a joist hanger 201 according to the preferred method of the present invention, the press has a plurality of stations, and the coil is fed incrementally into the press. At each station successive operations are performed on the coil, until the finished hanger 201 is ejected from the final station. The following steps can be performed with a 100 ton press to make a channel-shaped joist hanger 201 from 18 gauge galvanized sheet metal. The progressive press is ideally run at approximately 100 strokes per minute.

The width of the coil varies depending upon the size and number of hanger blanks or pieces 1 which will be having identical operations performed on them at a particular point in the press. In the preferred method for forming a light gauge, joist hanger 201 suitable for panelized roof construction, the coil is wide enough to accommodate two blanks or parts traveling through the press side-by-side.

The coil is fed incrementally into the press. At the first pair of stations in the progressive press, pilot holes 22, notches and any openings in the part are formed. The pilot holes 22 are the largest circular openings in the back member 15 shown in FIG. 1. They are used only for tooling and guide the coil through the progressive punch press. It is in this first pair of piercing stations, that the closed perimeter openings 6 and 106 unique to this invention are formed in what will be the continuous curved side flanges 8 and 108 of the hanger 201.

Next the blank is partially cut from the coil, but not completely. A portion of the part, between where the first and second side flanges 8 and 108 end and what will become the top flange 23 begins remains connected to the parts before it and behind it in the coil . See FIG. 1. This allows the blank or part 1 to continue to be pushed through the progressive press. Also, as mentioned above, there are two parts 1 traveling through the press side-by-side, and at this point the two are still connected.

At the next pair of stations, the embossments 24 for strengthening the top flange 23 are formed.

At the next pair of stations dimples 25 and 125 are formed in what will be the side flanges 8 and 108.

At the next pair of stations, portions of the outer margins of the blank are bent up normal to the web portion 9 to form a channel-shaped portion consisting of a base or web 9 portion with opposed side flanges 8 and 108.

At the next station, the two parts 1 traveling side by side are separated by a lance, and the part is stamped with any necessary indicia, labeling or instructions.

Next, the top flanges 23 in each part 1 are bent down by a wiping punch known in the art.

Finally, the part that will become the joist hanger 201 is moved into the final station. See FIGS. 21 through 25. At this station, it is first cut from the coil and then bent along the transverse bend line 14 by a male forming punch press 301 and a mating female forming punch die 302. The male forming punch press 301 is driven downwards and bends the part 1 along the transverse bend line 14.

The cut is made by a cutter press 401 located on the upper movable platen 303 and a stationary punch press 402 located on the bottom platen 304. The bottom edge 403 of the cutter press 401 lies just below the lowest point of the punch press 301. This distance is preferably the thickness of the coil. This allows the cutter press 401 to cut the part 1 from the coil in combination with the cutter die 402 before the punch press 301 begins to form the transverse bend in the part 1.

In the last station, generally the clearance between the sides 305 of the punch press 301 and the inner side walls 306 of the lower punch die is substantially equal to the thickness of the coil to give support to the side flanges 8 and 108. Other portions 305*a* of the sides 305 of the punch press 301 can be scalloped to accommodate portions of the side flanges 8 and 108 which are not substantially in the same plane. See FIG. 11.

The punch die 302 has a recessed portion or matrix cavity 307 and inner side walls 306 that support distal side portions 10 and 110 of the first and second flanges 8 and 108. The inner side walls 306 are substantially vertical, but the bottom of the cavity 307 tapers from two directions at angles of 45 degrees. In the preferred embodiment used on a progressive press, the lower punch die 302 is made up of a plurality of parts. The lower punch die 302 has a rectangular containment die portion 308 containing two angular die members 309. Each angular die member 309 has a slanted face 310 sloping toward the center of the rectangular containment die portion 308. These slanted faces 310 are disposed at 90 degrees to each other. Located between the angular die members 309 is a moveable lifter 311. The lifter 311 sits on a spring 312 which can be a mechanical spring or a gas spring. In the preferred progressive press it is a nitrogen gas spring.

The upper moveable portion of the press for this station, the punch press 301, is formed with an ejector pin 313 that engages the part 1 before the punch press 301 reaches it.

The ejector pin 313 is moved by a spring 314 as well, which can be a mechanical spring or a nitrogen spring. The springs 314 and 312 for the ejector pin 313 and the lifter 311 are chosen such that the ejector pin 313 cannot substantially move the lifter 311. The lifter 311 of the punch die 302 engages the part 1 before the part 1 reaches it. The ejector pin 313 and the lifter 311 support the part 1 during the cutting operation that occurs higher up on the downward stroke. The lifter 311 is also used in the progressive press to eject the hanger 201 from the lower die 302 after the transverse bend has been formed.

After the piece is cut from the coil, the punch press 301 continues to descend, engages the part 1 at the rounded tip 315 of the punch press 301 and forces the material of the part 1 to deform around its tip 315 and into the recessed portion 307 of the lower punch die 302. The round tip 315 has a radius of one material thickness. The punch press 315 has angular sides 316 disposed at 90 degrees to each other.

During the forming operation in the last station, along the flanges 8 and 108 in the area surrounding the transverse bend line 14 the metal will be in compression due to the inwardly swinging movement of the flanges 8 and 108 on opposite sides of the bend that will be formed. Because of the force at which the punch press 301 forces the part 1 downward, plastic deformation of the metal of the flanges 8 and 108 near the transverse bend line 14 will occur. In the prior art wiping operations, the plasticized metal would fold on itself, or buckle, which could lead to tearing and wrinkling. The inventor has noticed from observing hangers made according to the conventional process, that as the pieces of the die press wear with use, tearing of the metal becomes more of a problem. The tearing of the metal in the flanges of the part causes mechanical deformities in the die and punch, which in turn lead to larger wrinkles and tears in the press and so on. But in the present invention, because of the presence of the closed perimeter openings 6 and 106 in the compression area of the flanges 8 and 108, the plasticized metal is allowed to flow unhindered into the openings 6 and 106, such that it need not fold on itself causing wrinkles, bulges, crimps or tears. That is to say, the closed perimeter openings 6 and 106 provide areas into which the metal of the side flange 8 and 108 can flow without bunching up onto itself.

In an alternate method of the present invention, a connector 202 with only one flange 8 is formed with a transverse bend creating a continuous corner flange. See FIGS. 17 through 20.

As in the method descried previously, preferably, a ⅛" diameter closed perimeter opening 6 is formed in the portion of the blank 1" that will become the side flange 8. The closed perimeter opening 6 is also located near the transverse bend line 14. The closed perimeter opening 6 is also positioned so that it will lie just above the curved portion in the side flange 8 which results from first bending the flange 8 along the flange bend line 7 and then bending the entire part along the transverse bend line 14.

After the closed perimeter opening 6 is formed, the flange 8 is formed by bending the part along the flange bend line 7 . Preferably, this bend has an inner radius of one part thickness.

Finally, the part is bent along the transverse bend line 14. Preferably, this bend also has an inner radius of one part thickness.

The punch press 501 and punch die 502 for making connector 202 with only a single flange is similar to the punch press 301 and 302 punch die for making a part with first and second flanges 8 and 108, and the description of like parts with similar functions is not repeated. Like parts are given like numbers, except they begin with the numeral 5 instead of the numeral 3. The lower punch die 502 need only have one inner sidewall 506.

In this alternate method, the lower punch die 502 for making the transverse bend is formed with a lifter 511 which is necessary to serve as a clamping member. The lifter 511 holds the part against the punch press 501, so that it moves with the punch press 501 and is not unduly stretched during the formation of the transverse bend. Like the lifter 311 described for the part 1 with two side flanges 8 and 108 formed in a progressive press the lifter 511 is actuated by a spring 512. The spring 512 can be a mechanical spring or a pneumatic spring. The lower punch die 502 is similar to the other lower punch die 302 described previously.

The preferred connector 201 formed according to the method of the present invention has a back 15, a seat 16 connected to the back along a transverse bend line 14, first and second continuous corner flanges 8 and 108 and first and second closed perimeter openings 6 and 106 in the first and second continuous corner flanges 8 and 108.

The first continuous corner flange 8 of the preferred connector 201 is connected to the back 15 and the seat 16 along a first flange bend line 7. The first continuous corner flange 8 has a seat flange portion 18 and a back flange portion 17. The seat flange and back flange portions 18 and 17 lie substantially in a single plane and are disposed at angles to each other such that the continuous corner flange 8 appears bent. The first continuous corner flange 8 also has at least one closed perimeter opening 6 on the transverse bend line 14, the closed perimeter opening 6 being partially shaped by punching and partially by material flow in the seat flange and back flange portions 18 and 17 resulting from inwardly bending the continuous corner flange 8 on itself by bending the back 15 and seat 16 towards each other along the transverse bend line 14.

The second continuous corner flange 108 is connected to the back 15 and the seat 16 along a second flange bend line 107, the second continuous corner flange 108 has a seat flange portion 118 and a back flange portion 117, the seat flange and back flange portions 118 and 117 of the second flange lie 108 substantially in a single plane and are disposed at angles to each other such that the second continuous corner flange 108 appears bent. The second closed perimeter opening 106 in the second flange 108 lies on the transverse bend line 14. The second closed perimeter opening 106 is partially shaped by punching and partially by material flow of the seat flange and back flange portions 117 and 118 resulting from inwardly bending the second continuous corner flange 108 on itself by bending the back 15 and seat 16 towards each other along the transverse bend line 14.

The preferred connector 201 formed according to the present invention is a joist hanger used in panelized construction.

The preferred connector 201 formed according to the present invention also has a top flange 23 connected to the back 15 along a top flange bend line 28, the top flange 23 is disposed away from the back member 15 in a direction opposite to the seat 16. The top flange 23 is used to attach the connector 201 to a header or beam. In the preferred connector 201, dimples 25 and 125 are embossed in the first and second continuous corner flanges 8 and 108 to better hold a joist in the connector 201. The joist held in the connector 201 is pinched by the dimples 25 and 125 and rests on the seat 16. The connector 201 also has longitudinal embossments 24 that start in the top flange 23 extend through the top flange bend line 28 and end in the back 15 to stiffen the connector 201. Also the first and second flange bend lines 7 and 107 have curved portions near the top flange bend line 28. This causes the side flanges 8 and 108 to spread outward as they near the top flange bend line 28. The spreading flanges 8 and 108 make it easier to insert a joist into the connector 201.

The preferred connector 201 formed according to the present invention also has a pair of slotted openings 26 in the top flange 23 for receiving fasteners and a rectangular opening 27 in the back 15 for receiving an optional fastener. The corners of the part are chamfered to lessen the risk of being cut by the part. See FIG. 1.

The preferred connector 201 is made from 18 gauge galvanized G60 ASTM A653 LFQ sheet steel with a minimum yield strength of 33 ksi and an ultimate strength of 45 ksi. The closed perimeter openings 6 and 106 are formed with a ⅛" diameter. The side flanges 8 and 108 as measured from the distal side 2 of the back 15 to the top 12 or 112 of the flange 8 or 108 at a point well away from the transverse bend line 14 are approximately 1 ½" tall. The back is dimensioned to receive a 2×4 or 2×6. Both the seat 16 and top flange 23 extend approximately 1" from the back 15.

I claim:

1. A method for shaping a piece of bendable sheet material having a distal side and a proximal side and first and second ends, comprising:

a. forming a closed perimeter opening in said piece, said closed perimeter opening having a first shape;

b. bending said piece along a flange bend line so that said piece adopts a first intermediate position, said flange bend line dividing said piece into a flange that contains said closed perimeter opening and a web to the other side of said flange bend line, said flange having distal and proximal sides, a top disposed away from said flange bend line and a bottom coincident with said flange bend line; and c. bending said web along a transverse bend line that divides said web into a seat and a back and said flange into a seat flange and a back flange, so that said piece adopts a second position, said transverse bend line lying near said closed perimeter opening, while bending said web along said transverse bend line simultaneously supporting portions of said distal and proximal sides of said flange such that said seat flange and said back flange are swung inwardly on each other, such that portions of said seat flange and said back flange near said ends of said part are bent out of line and lie at an angle to each other, said bending being carried out with a force sufficient to create compression forces in portions of said flange near said transverse bend line, causing portions of said flange to plasticize and flow into said closed perimeter opening in said flange, such that said closed perimeter of said opening is deformed by said material flow and said opening adopts a second smaller shape than said first shape.

2. The method of claim 1, further comprising:

a. forming an additional closed perimeter opening in said piece with a first shape, said additional closed perimeter opening being located in said flange near said transverse bend line, said first and additional closed perimeter openings lying substantially similar distances from where said transverse bend line and said flange bend line intersect; and b. said additional closed perimeter opening also being deformed by said material flow, such that said additional closed perimeter opening adopts a second smaller shape than said first shape when said bending along said transverse bend line occurs.

3. The method of claim 1, wherein:

said operation of forming said closed perimeter opening in said flange occurs after said flange has been formed by bending said piece along said flange bend line.

4. The method of claim 1, further comprising:

a. forming a second closed perimeter opening in said piece simultaneously with said closed perimeter opening, said second closed perimeter opening having a first shape;

b. bending said piece along a second flange bend line that has a portion substantially parallel to said flange bend line simultaneously with said bending along said flange bend line, said second flange bend line dividing said piece into a second flange that contains said second closed perimeter opening and said web to the other side of said second flange bend line, said second flange having distal and proximal sides, a top disposed away from said second flange bend line and a bottom coincident with said second flange bend line, and wherein when said piece is bent along said transverse bend line that divides said web into said seat and said back and said flange into said seat flange and said back flange, said transverse bend lines also divides said second flange into a second seat flange and a second back flange, and said transverse bend line lies near said second closed perimeter opening; and c. while bending said web along said transverse bend line simultaneously supporting portions of said distal and proximal sides of said second flange such that said second seat flange and said second back flange are swung inwardly on each other, such that portions of said second seat flange and said second back flange near said ends of said part are bent out of line and lie at an angle to each other, said bending occurring with a force sufficient to create compression forces in portions of said second flange near said transverse bend line, causing portions of said second flange to plasticize and flow into said second closed perimeter opening in said second flange, such that said closed perimeter of said second opening is deformed by said material flow and said second closed perimeter opening adopts a second smaller shape than said first shape.

5. The method of claim 1, wherein:

said closed perimeter opening lies on said transverse bend line.

6. The method of claim 1, wherein:

said closed perimeter opening lies closer to said flange bend line than to said top of said flange.

7. The method of claim 1, wherein:

a. said sheet material has a given thickness; and b. said closed perimeter opening and said top of said flange are separated from each other by a space wider than said thickness of said sheet material.

8. The method of claim 1, wherein:

a. portions of said flange near said bottom of said flange are curved by said bending of said flange along said flange bend line; and b. said closed perimeter opening lies adjacent to said curved portion of said flange.

9. The method of claim 1, wherein:

said bends occurring along said flange bend line and said transverse bend line are tight-radius, 90 degree bends.

10. A method of making a substantially channel-shaped joist hanger from a piece of sheet material, comprising:

a. providing closed perimeter openings in said piece, each of said closed perimeter openings having a first shape;

b. bending said piece into a substantially channel-shaped, first intermediate position, having a central web and first and second flanges, by bending said piece along first and second flange bend lines, each said flange having a distal and a proximal side, a top disposed away from said flange bend line and a bottom coincident with said flange bend line, with at least one closed perimeter opening occurring in each of said flanges;

c. bending said web along a transverse bend line that divides said web into a seat and a back and said flanges into seat flanges and back flanges, so that said piece adopts a second position, said transverse bend line lying near said closed perimeter openings, while bending said web along said transverse bend line simultaneously supporting portions of said distal and proximal sides of said flanges such that said seat flanges and said back flanges are swung inwardly on each other, such that portions of said corresponding seat flanges and said back flanges near said ends of said part are bent out of line and lie at an angle to each other, said bending occurring with a force sufficient to create compression forces in portions of said flanges near said transverse bend line, causing portions of said flanges to plasticize and flow into said closed perimeter openings in said flanges, deforming and reducing said first shape of said closed perimeter openings such that each of said closed perimeter openings adopts a second shape.

* * * * *

UNITED STATES PATENT AND TRADEMARK OFFICE

CERTIFICATE OF CORRECTION

PATENT NO. : 6,260,402 B1
DATED : July 17, 2001
INVENTOR(S) : William F. Leek

It is certified that error appears in the above-identified patent and that said Letters Patent is hereby corrected as shown below:

Column 14,
Line 43, replace "transverse bend lines" with -- transverse bend line --.

Signed and Sealed this

Ninth Day of April, 2002

*Attest:*

*Attesting Officer*

JAMES E. ROGAN
*Director of the United States Patent and Trademark Office*